US009327897B2

(12) United States Patent
Fily

(10) Patent No.: US 9,327,897 B2
(45) Date of Patent: May 3, 2016

(54) COMBINATION CONTAINER AND DEVICE, AND METHOD OF USING SAME

(71) Applicant: Galderma R&D, Sophia Antipolis (FR)

(72) Inventor: Sebastien Fily, Sophia Antipolis (FR)

(73) Assignee: Galderma Research & Development, Sophia Antipolis (FR)

( * ) Notice: Subject to any disclaimer, the term of this patent is extended or adjusted under 35 U.S.C. 154(b) by 234 days.

(21) Appl. No.: 13/729,229

(22) Filed: Dec. 28, 2012

(65) Prior Publication Data

US 2014/0183226 A1 Jul. 3, 2014

(51) Int. Cl.

| | |
|---|---|
| ***B65D 83/00*** | (2006.01) |
| ***B65D 25/20*** | (2006.01) |
| ***B65D 55/00*** | (2006.01) |

(52) U.S. Cl.

CPC ..... *B65D 83/0044* (2013.01); *B65D 25/20* (2013.01); *B65D 55/00* (2013.01)

(58) Field of Classification Search

CPC .. B65D 47/121; B65D 83/222; B65D 50/045; B65D 83/205; B65D 21/0231; B65D 83/40; B65D 77/065; B65D 21/0224; B65D 21/0235; B65D 2543/00296; B65D 21/0213; B65D 21/0233; B65D 85/20; B05B 11/3059; A47G 19/24; G03G 15/0834; A45D 40/24

USPC ..... 222/153.01, 153.11, 402.11, 402.12, 222/402.13, 143, 183, 182, 173, 167, 168, 222/1, 153.13, 153.14; 206/503, 504, 508, 206/509, 515, 446, 385; 215/10

See application file for complete search history.

(56) References Cited

U.S. PATENT DOCUMENTS

| | | | | |
|---|---|---|---|---|
| 2,818,997 A * | 1/1958 | Henchert | ..... | 222/143 |
| D204,822 S | 5/1966 | Barker | | |
| 4,787,508 A * | 11/1988 | Wu et al. | ..... | 206/445 |
| D306,639 S | 3/1990 | Wills | | |
| 5,499,747 A * | 3/1996 | Quennessen | ..... | 222/167 |

(Continued)

FOREIGN PATENT DOCUMENTS

| | | |
|---|---|---|
| FR | 2675116 A3 | 10/1992 |
| GB | 1358699 A | 7/1974 |

OTHER PUBLICATIONS

Int'l Search Report and Written Opinion issued Feb. 26, 2014 in Int'l Application No. PCT/US2013/077963.

(Continued)

*Primary Examiner* — Kevin P Shaver
*Assistant Examiner* — Michael J Melaragno
(74) *Attorney, Agent, or Firm* — Panitch Schwarze Belisario & Nadel LLP

(57) ABSTRACT

A combination includes a container having a body with a first end and a second end. The body defines a cavity for holding contents to be dispensed from the container. An actuator is positioned proximate to the first end of the body. The actuator is operatively connected to the cavity to allow the contents to be dispensed therefrom. At least two diametrically opposed first fastening members are positioned on or in the body. A device has a generally open first end, a generally open second end, and a sidewall extending therebetween. The device is removably mountable onto the body of the container. At least two diametrically opposed second fastening members are positioned on or in an interior surface of the sidewall. Each second fastening member engages at least a portion of one of the first fastening members of the container when the device is mounted onto the container.

18 Claims, 4 Drawing Sheets

(56) References Cited

U.S. PATENT DOCUMENTS

| | | | | |
|---|---|---|---|---|
| 5,704,471 | A | 1/1998 | Yamada | |
| 7,044,337 | B1 * | 5/2006 | Kou | 222/153.11 |
| D616,747 | S | 6/2010 | Stull et al. | |
| 8,043,005 | B2 | 10/2011 | Lyon et al. | |
| 8,308,029 | B2 * | 11/2012 | Ki | 222/309 |
| D679,592 | S | 4/2013 | Stull, Sr. et al. | |
| D701,763 | S | 4/2014 | Chur | |
| 2006/0191947 | A1 | 8/2006 | Jedryk et al. | |
| 2007/0131738 | A1 | 6/2007 | Erdie | |
| 2010/0206907 | A1 | 8/2010 | Angus et al. | |

OTHER PUBLICATIONS

U.S. Appl. No. 29/468,270 by Fily, filed Sep. 27, 2013.

* cited by examiner

COMBINATION CONTAINER AND DEVICE, AND METHOD OF USING SAME

BACKGROUND OF THE INVENTION

The present invention relates generally to a combination container and device, and, more particularly, to a device that allows two or more containers to be vertically stacked, and subsequently or previously used without removing the device from the lower container(s).

Containers for holding or storing contents or a substance, such as skin lotion or liquid soap, are well known. Such containers typically include an actuator that allows the contents to be selectively pumped, dispensed or otherwise removed from the container.

It is desirable to vertically stack such containers for storage, display and/or transportation purposes to conserve space. It is known to place a removable over-cap on top of each container to generally cover or surround the actuator, so that the containers can be stacked. The over-cap also protects the relatively fragile actuator, and prevents inadvertent pumping or activation of the actuator.

However, users typically do not replace the over-caps onto the containers after use. At least certain users view the separable over-caps as unnecessary additional plastic, and/or have difficulty in temporarily storing the over-cap in a convenient or memorable place when using the actuator of the container. As a result, the removable over-caps are often prematurely discarded or inadvertently misplaced, thereby preventing the containers from being stacked.

It has yet to be discovered how to stack conventional containers having an actuator without using a removable over-cap, while still obtaining the benefits of a removable over-cap. The present invention accomplishes the above objectives.

BRIEF SUMMARY OF THE INVENTION

Briefly stated, one aspect of the present invention is directed to a combination including a container having a body with a first end and an opposing second end. A longitudinal axis extends from the first end to the second end. The body defines a cavity for holding contents to be dispensed from the container. An actuator is positioned proximate to the first end of the body. The actuator is operatively connected to the cavity to allow the contents to be selectively dispensed from the cavity. At least two diametrically opposed first fastening members are positioned on or in the body proximate the first end thereof. The combination also includes a device having a generally open first end, a generally open second end, and a sidewall extending between the open first end and the open second end. The sidewall has an interior surface and an opposing exterior surface. The interior surface of the sidewall has a shape that generally complements a shape of at least a portion of the first end of the body of the container such that the device is removably mountable onto at least a portion of the first end of the body of the container. At least two diametrically opposed second fastening members are positioned on or in the interior surface of the sidewall. Each second fastening member engages at least a portion of one of the first fastening members of the container when the device is mounted onto the container.

In another aspect, the present invention is directed to a method of using a container having an actuator to dispense contents within the container. The method includes rotating the device with respect to a container from a first rotational position to a second rotational position. The device generally surrounds the actuator in both the first and second rotational positions. The method includes moving the device linearly downwardly with respect to a longitudinal axis of the container from a first vertical position to a second vertical position. The device generally surrounds the actuator in the first vertical position. The actuator is generally exposed to allow a user to dispense the contents from the container when the device is in the second vertical position.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
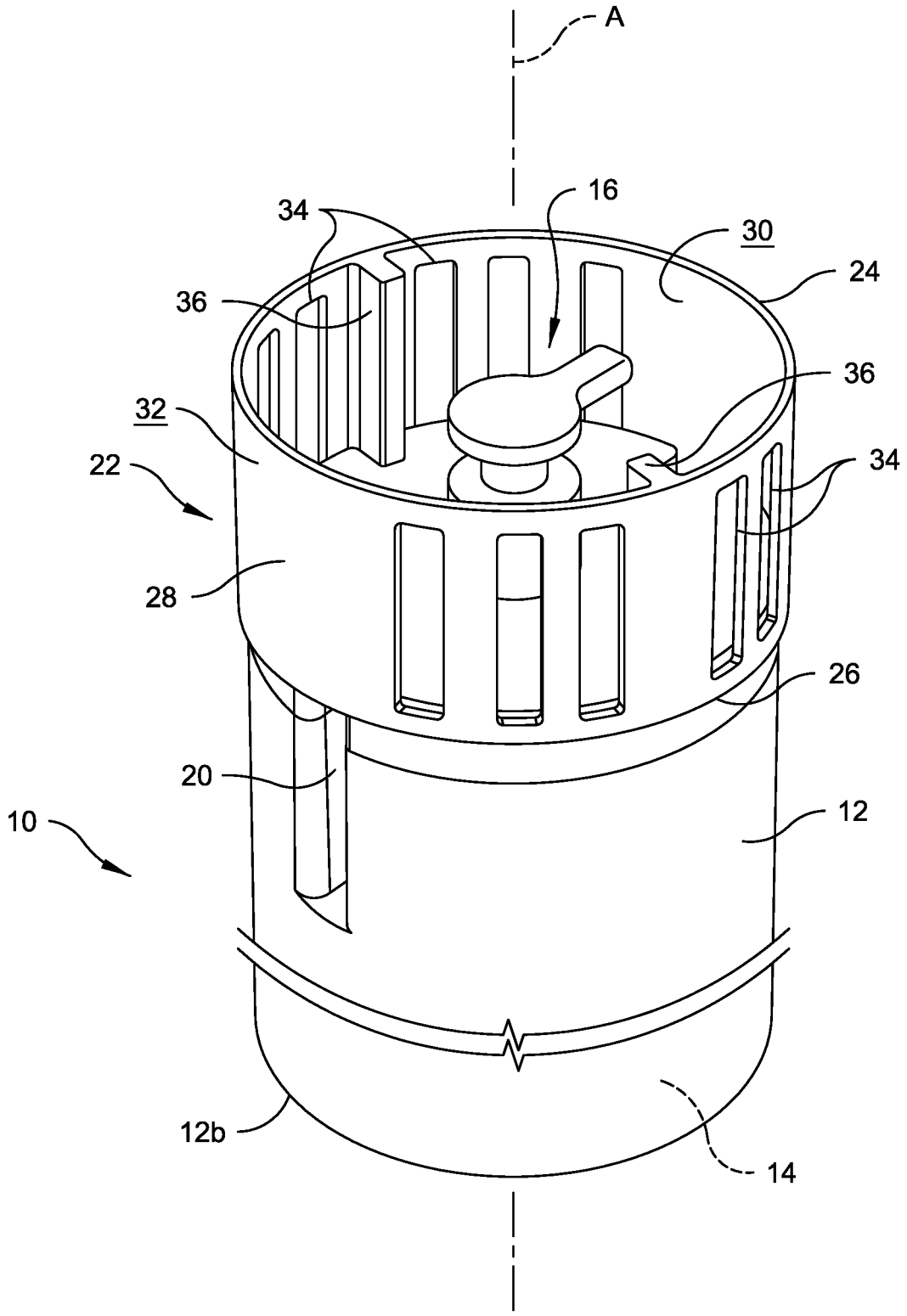
FIG. 1 is a top partial perspective view of a combination container and device according to a preferred embodiment of the present invention, wherein the device is shown in a first rotational position.

Certain terminology is used in the following description for convenience only and is not limiting. The words "lower," "upper" and "top" designate directions in the drawings to which reference is made. The words "upwardly," "downwardly" and "inwardly" refer to directions toward and away from, respectively, the geometric center of the combination, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout, FIGS. 1-4 illustrate a combination of a container, generally designated 10, and a device, generally designated 22, according to a preferred embodiment of the present invention. The container 10 is preferably designed to hold, store and/or selectively dispense contents or a substance (not shown) therein, and the device 10 is preferably designed to allow a second, generally identical container (not shown) to be stacked on top of the first container 10. The present invention is not limited to a particular contents or substance stored, displayed and/or transported within the container 10. For example, the contents may be a generally viscous material, such as skin lotion, liquid soap, a cleanser or disinfectant, or mouthwash. However, the contents may also be one or more generally solid objects, such as a plurality of pills or capsules, or dispensed in the form of a vapor, such as hair or deodorant spray.

Referring to FIGS. 1-4, the container 10 includes a body 12 having a first end 12*a* and an opposing second end 12*b*. A longitudinal axis A of the container 10 extends linearly from the first end 12*a* to the second end 12*b* of the body 12. Each of the first and second ends 12*a*, 12*b* are preferably at least generally closed, such that the body 12 defines a cavity 14 for holding the contents or substance to be dispensed from the container 10. When viewed from above or below, the container 10 preferably has a generally circular shape such that the container 10 is generally cylindrical. The container 10 is preferably formed of, but not limited to, a light-weight, high-strength material, such as a polymeric material. The container 10 may be generally opaque, translucent or transparent.

Figure 4:
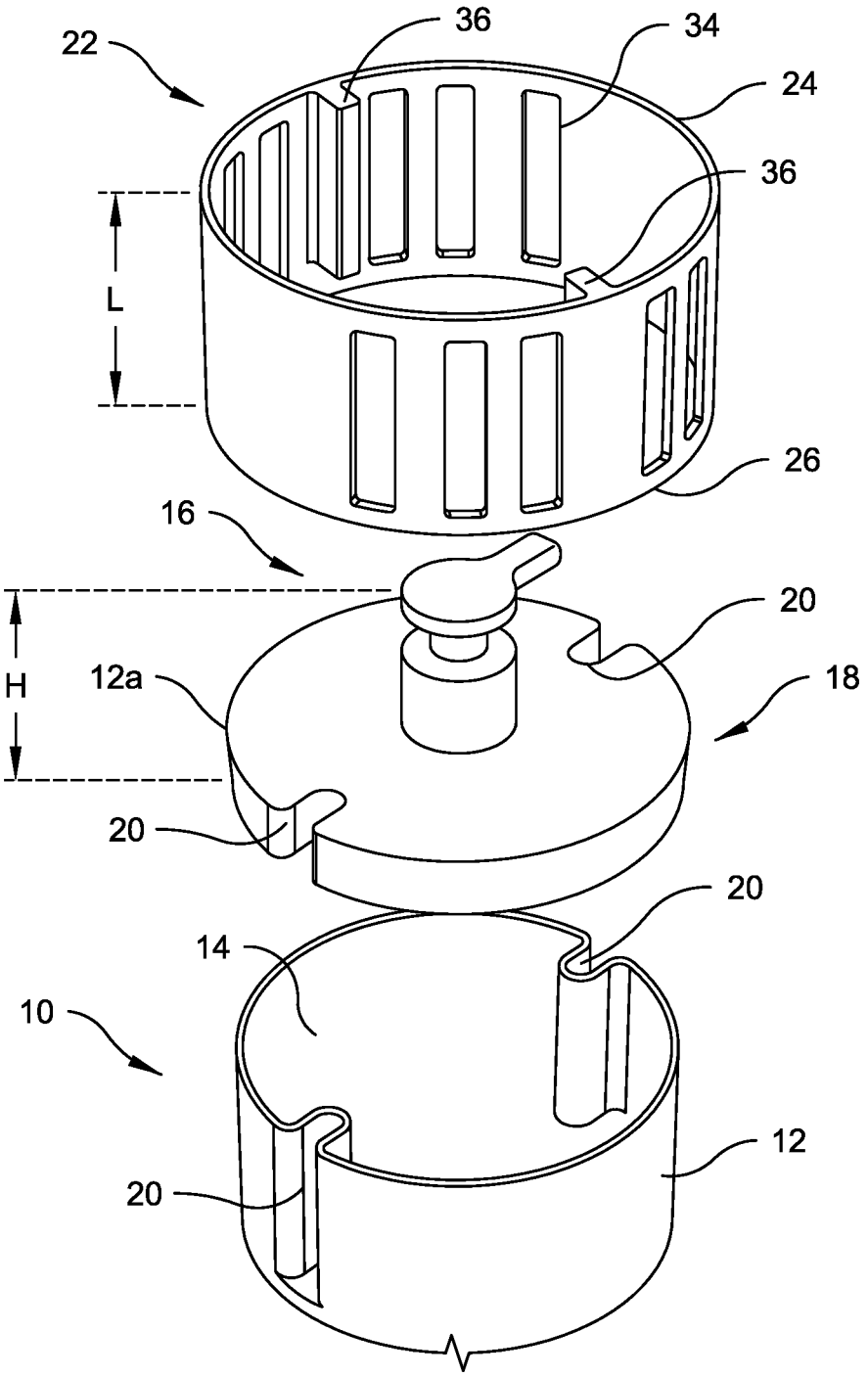
FIG. 4 is a top perspective exploded view of the combination of FIG. 1.

As shown in FIGS. 1 and 4, the container 10 may include a cap 18. The cap 18 may be integrally, unitarily and/or monolithically formed with at least a portion of the first end 12*a* of the body 12, or the cap 18 may be removably attached to the first end 12*a* of the body 12. In other words, the cap 18 may be formed or located at the first end 12*a* of the body 12, or the cap 18 may be attached to at least a portion of the first end 12*a* of the body 12. The removable cap 18 may allow the cavity 14 of the container 10 to be more easily refilled, such as by removing the cap 18 from the first end 12*a* of the body 12 and inserting more contents into the cavity 14 therein.

Referring again to FIGS. 1-4, the container 10 preferably includes an actuator 16 positioned proximate to the first end 12*a* of the body 12 and/or the cap 18. More particularly, the actuator 16 extends upwardly from the first end 12*a* of the body 12 and/or the cap 18 along the longitudinal axis A. The actuator 16 is preferably a pump that is operatively connected to the cavity 14 of the container 10 to allow the contents to be selectively dispensed therefrom. The actuator 16 is not limited to a particular size, shape, configuration and/or type, so long as the actuator 16 accomplishes the functionality described herein. For example, the actuator 16 may be of the lockable or non-lockable variety, and may be configured to spray or atomize the contents of the container 10.

At least a portion of the actuator 16 is preferably movable between a downward position and an upward position. The actuator 16 is preferably biased to the upward position, as shown in FIGS. 1-4. In operation, the actuator 16 may be depressed downwardly along the longitudinal axis A to force at least some of the contents out of the cavity 14 through the actuator 16. Once a sufficient and/or predetermined amount of the contents is released or dispensed from the container 10, the actuator 16 is preferably released and allowed to return to an initial, upward position.

Referring to FIGS. 1-4, the container 10 includes at least one and preferably at least two diametrically opposed first fastening members 20 positioned on or in the body 12 proximate the first end 12*a* thereof and/or the cap 18. More preferably, each first fastening member 20 extends on or in at least a portion of both the cap 18 and the body 12. Each first fastening member 20 preferably extends generally parallel to the longitudinal axis A. The container 10 may include more or even less first fastening members 20, if desired.

More specifically, each first fastening member 20 preferably is in the form of a groove extending radially inwardly into at least a portion of the body 12 and/or the cap 18 of the container 10. Each first fastening member 20 is preferably generally concave in shape. Each first fastening member 20 may be integrally, unitarily and/or monolithically formed on or in the body 12 and/or the cap 18 of the container 10. Alternatively, each first fastening member 20 may be formed on or in a component (not shown) that is removably mountable onto at least a portion of the body 12 and/or the cap 18 of the container 10. The component may be a sleeve that slips or slides over a portion of the container 10.

As shown in FIGS. 1-4, the device 22 is preferably movably and/or removably mountable onto the container 10. In contrast to conventional over-caps, as described above, the device 22 is preferably movable on the container 10 without having to completely remove or detach the device 22 from the container 10. The device 22 prevents damage of certain portions of the container 10, prevents inadvertent dispensing of the contents from the container 10, and allows multiple containers 10 to be vertically stacked for storage, display and/or transport thereof. The device 22 allows for the above-described functionality without modifying the structure of the container 10 itself. The device 22 is preferably formed of, but not limited to, a generally light-weight, high-strength material, such as a generally rigid polymeric material.

The device 22 preferably has a generally open first or upper end 24, a generally open second or lower end 26, and a sidewall 28 extending between or from the open first end 24 and the open second end 26. The generally open first end 24 requires less material to form the device 22, as compared to closed top-type prior art items, which is beneficial in terms of cost and environmental impact. As shown in FIG. 4, a length L of the sidewall 28 of the device 22, as measured along the longitudinal axis A when the device 22 is properly attached to the container 10, is preferably at least generally equal to (or possibly slightly greater than) a height H that the actuator 16 extends upwardly from the first end 12*a* of the body 12 and/or the cap 18 of the container 10 when the actuator 16 is in an upwardly position (see FIGS. 1-4). The sidewall 28 is preferably generally tubular in shape, and preferably has a generally circular shape when viewed from above or below.

The sidewall 28 has an interior surface 30 and an opposing exterior surface 32. The interior surface 30 of the sidewall 28 of the device 22 preferably has a diameter that is at least slightly greater than an outer diameter of the container 10 and/or the cap 18. Thus, the interior surface 30 of the sidewall 28 of the device 22 preferably has a shape that generally complements a shape of at least a portion of the first end 12*a* of the body 12 and/or the cap 18 of the container 10, such that the device 22 can be removably mountable thereon and movable with respect to the container 10.

The sidewall 28 of the device 22 preferably includes at least one and more preferably a plurality of circumferentially spaced-apart openings 34, such that the device 22 is at least partially perforated. Such a configuration reduces material costs during manufacturing and lightens the overall weight of the device 22. Each opening 34 is preferably generally rectangular in shape and extends along the longitudinal axis A at least generally from the first end 24 to the second end 26 of the device 22. The openings 34 may be equidistantly spaced-apart around a circumference of the device 22, or the openings 34 may be spaced-apart in groups of three, as shown in FIGS. 1-4, or even groups of more or less.

Referring to FIGS. 1-4, the device 22 preferably includes the same number of second fastening members 36 as the number of first fastening members 20 that are included on or in the container 10. In particular, at least one and more preferably at least two diametrically opposed second fastening members 36 are positioned on or in the interior surface 30 of the sidewall 28 of the device 22. Each second fastening member 36 preferably extends generally, if not exactly, parallel to the longitudinal axis A when the device 22 is properly mounted to the container 10. Each second fastening member 36 preferably extends at least generally, if not completely, from the first end 24 to the second end 26 of the device 22. Each second fastening member 36 of the device 22 preferably engages at least a portion of one of the first fastening members 20 of the container 10 when the device 22 is properly mounted onto the container 10.

In particular, it is preferred that each second fastening member 36 is in the form of a generally complementary rib that extends radially inwardly from the interior surface 30 of the sidewall 28 of the device 22. Each second fastening member 36 is preferably at least slightly smaller than the corresponding first fastening member 36, such that the second fastening member 36 can movably fit therein. Each second fastening member 36 is preferably integrally, unitarily and/or monolithically formed on or in the device 22. Alternatively, each second fastening member 36 may be removably attached to at least a portion of the device 22.

Figure 2:
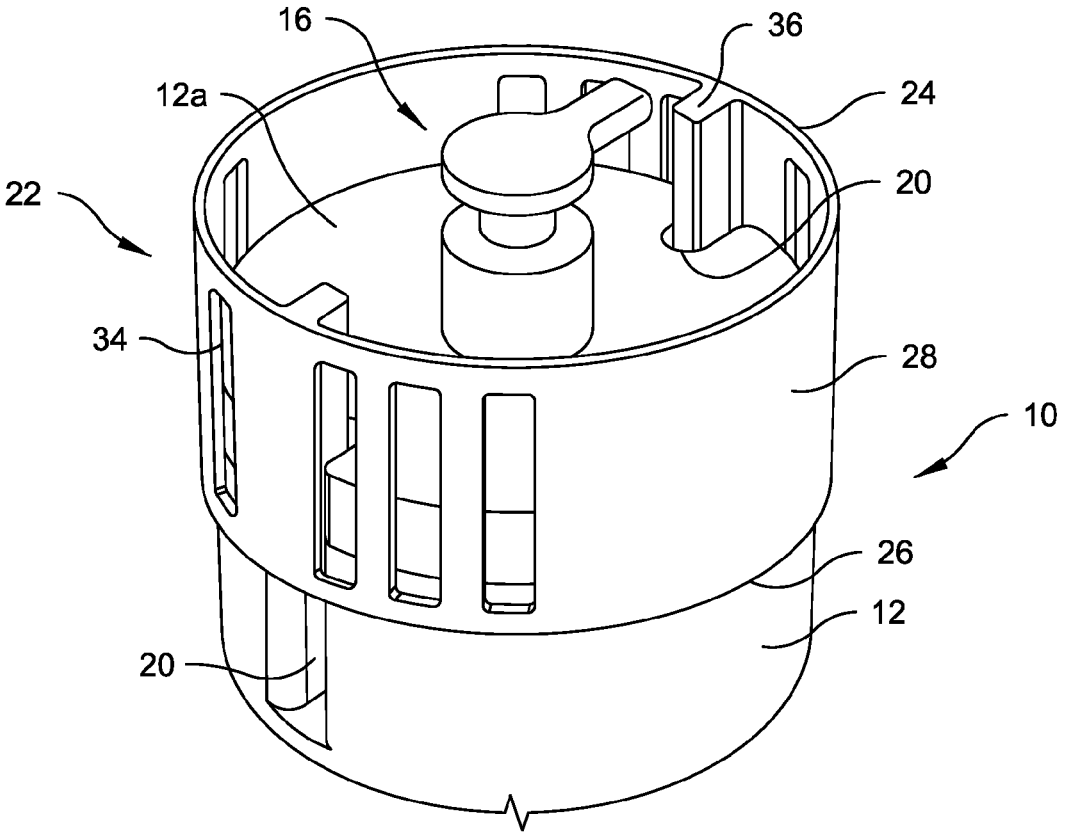
FIG. 2 is another top partial perspective view of the combination of FIG. 1, wherein the device is shown between a first and second vertical position of a second rotational position.
Figure 3:
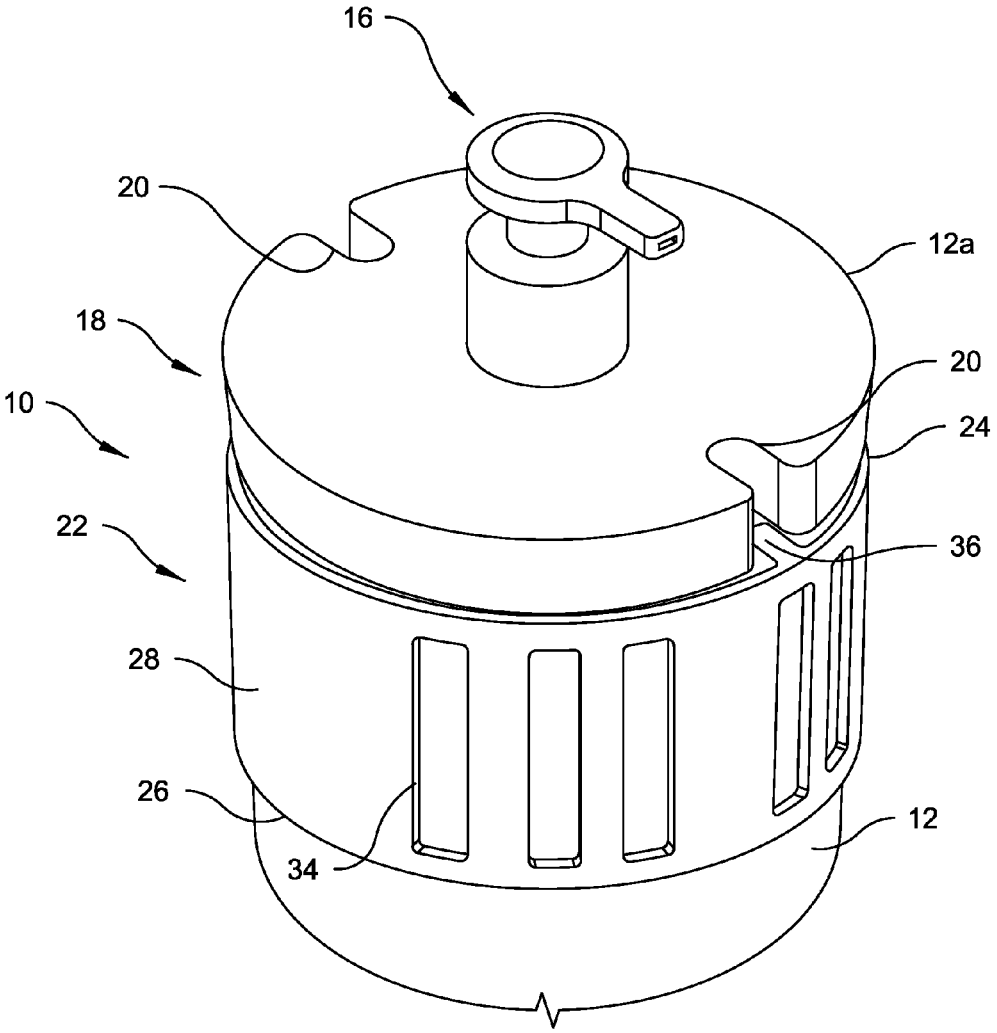
FIG. 3 is yet another top perspective view of the combination of FIG. 1, wherein the device is shown in the second vertical position of the second rotational position.

The device 22 is preferably movably and/or removably mountable onto at least a portion of the container 10 in both a first rotational position (see FIG. 1) and a second rotational position (see FIGS. 2 and 3). The second rotational position is preferably circumferentially spaced-apart from the first rotational position by at least approximately, but preferably exactly, ninety degrees (90°). In other words, it is preferred that the device 22 be rotated with respect to the container 10 (either clockwise or counterclockwise) to move between the first and second rotational positions. Due to the complementary size, shape and/or configuration of the device 22 and the container 10, the device 22 may be rotated three hundred and sixty degrees (360°) with respect to the container 10 when the device 22 is placed thereon.

In the first rotational position (FIG. 1), the first end 24 of the device 22 is preferably positioned at a level generally equal to or at least slightly above a top of the actuator 16. In such a position, the actuator 16 is generally protected and it is difficult to inadvertently move the actuator 16 into the downward position to dispense the contents from the container 10. In addition, it is possible to easily stack or place a second container on top of the first container 10 by placing the second end 12*b* of the body 12 of the second container 10 on the first end 24 of the device 22. In the first rotational position (FIG. 1), the second fastening members 36 are preferably circumferentially spaced-apart from the first fastening members 20.

At least a portion of each second fastening member 36 preferably contacts and/or rests on at least a portion of the first end 12*a* of the body 12 and/or the cap 18 of the container 10 when the device 22 is in the first rotational position. More specifically, a lower end of each second fastening member 36 preferably directly contacts at least a portion of the first end 12*a* of the body 12 and/or the cap 18 when the device 22 is in the first rotational position. In such a position, a combination of the rigidity of the device 22 and the second fastening members 36 being supported by the body 12 and/or the cap 18 of the lower container 10 allow the upper (i.e., second) container to be placed on top of the device 22 (e.g., on the first end 24 thereof) in a stable manner.

In the second rotational position (FIGS. 2 and 3), the first end 24 of the device 22 is preferably configured to be positioned at a level either above or below the actuator 16. More specifically, in the second rotational position, the device 22 is preferably linearly movable between a first or upward vertical position (e.g., at least slightly upwardly from the position shown in FIG. 2) and a second or downward vertical position (e.g., FIG. 3) with respect to the container 10. The second vertical position is preferably spaced-apart from the first vertical position along the longitudinal axis A. In both the first and second vertical positions, each second fastening member 36 is preferably aligned with one of the first fastening members 20 with respect to the longitudinal axis A.

In the first vertical position of the second rotational position, the first end 24 of the device 22 is preferably positioned at a level generally equal to or at least slightly above the top of the actuator 16. To maintain the device 22 in the first vertical position, the user preferably directly grasps or holds the device 22. Otherwise, the device 22 will fall or otherwise move to the second vertical position due to the force of gravity. In the second vertical position, the first end 24 of the device 22 is preferably positioned below a level of a bottom of the actuator 16. Thus, the actuator 16 can be activated or otherwise employed without removing the device 22 from the container 10. As shown in FIG. 3, in the second vertical position, the first end 24 of the device 22 may be positioned below a level of a bottom of the cap 18 of the container 10, which may allow the cap 18 to be removed from the container 10 (e.g., for refilling purposes) without removing the device 22 from the container 22.

In the second vertical position, each second fastening member 36 is preferably positioned at approximately the same level along the longitudinal axis A as the respective first fastening member 20. In other words, in the second vertical position, each second fastening member 36 is preferably positioned generally entirely within the respective first fastening member 20, such that a lower end of each second fastening member 36 contacts and/or rests on a lower end of the respective first fastening member 20. In such a position, the actuator 16 can be moved between the upward and downward positions without interference by the device 22.

A preferred method of using the container 10 includes rotating or otherwise moving the device 22 with respect to the container 10 from the first rotational position (FIG. 1) to the second rotational position (FIGS. 2 and 3). The device 22 is then preferably slid or otherwise moved linearly downwardly with respect to container 10 along the longitudinal axis A from the first vertical position to the second vertical position (FIG. 3). At least a portion of the actuator 16 is preferably simultaneously or subsequently depressed or otherwise moved downwardly with respect to the body 12 to dispense the contents from the container 10. Next, a downward force is preferably removed or released from the actuator 16, such that at least a portion of the actuator 16 automatically returns to the upward position with respect to the body 12. The device 22 is preferably simultaneously or subsequently moved linearly upwardly with respect to the container 10 along the longitudinal axis A from the second vertical position to the first vertical position of the second rotational position. The device 22 is then preferably rotated or otherwise moved with respect to the container 10 from the first vertical position of the second rotational position to the first rotational position (FIG. 1). A second container may then be placed on top of the device 22. Additional containers may be stacked above the second container by employing additional devices, as described above.

As mentioned above, the device 22 may be completely removed and then separated or spaced-apart from the container 10. Alternatively, one of the container 10 and the device 22 may include one or more third fastening members (none shown) that abut and/or engage one or more fourth fastening members (not shown) on the other of the container 10 and the device 22. Contact and/or engagement between the third and fourth fastening members may prevent the device 22 from being completely removed from the container 10. It is preferred that the third and fourth fastening members to not disrupt or prevent the above described movement between or into the first and second rotational positions.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A combination comprising:

a container including:

a body having a first end and an opposing second end, a longitudinal axis extending from the first end to the second end, the body defining a cavity for holding contents to be dispensed from the container;

an actuator positioned proximate to the first end of the body, the actuator being operatively connected to the cavity to allow the contents to be selectively dispensed from the cavity;

at least two diametrically opposed first fastening members positioned on or in the body proximate the first end thereof; and a device including:

a generally open first end;

a generally open second end;

a sidewall extending between the open first end and the open second end, the sidewall having an interior surface and an opposing exterior surface, the interior surface of the sidewall having a shape that generally complements a shape of at least a portion of the first end of the body of the container such that the device is removably mountable onto at least a portion of the first end of the body of the container; and at least two diametrically opposed second fastening members positioned on or in the interior surface of the sidewall, each second fastening member engaging at least a portion of one of the first fastening members of the container when the device is mounted onto the container.

2. The combination according to claim 1, wherein the device is removably mountable onto at least a portion of the container in both a first rotational position and a second rotational position, the second rotational position being circumferentially spaced-apart from the first rotational position, in the first rotational position the first end of the device being positioned above the actuator, in the second rotational position the first end of the device being configured to be positioned above or below a level of the actuator.

3. The combination according to claim 2, wherein in the first rotational position the second fastening members being circumferentially spaced-apart from the first fastening members.

4. The combination according to claim 3, wherein in the second rotational position the device is linearly movable between a first vertical position and a second vertical position, the second vertical position being spaced-apart from the first vertical position along the longitudinal axis, in both the first and second vertical positions each second fastening member being aligned with one of the first fastening members with respect to the longitudinal axis.

5. The combination according to claim 4, wherein in the first rotational position at least a portion of each second fastening member contacting a portion of the first end of the body.

6. The combination according to claim 1, wherein each first fastening member comprises a groove extending radially inwardly into at least a portion of the body of the container and each second fastening member comprises a generally complementary rib extending radially inwardly from the sidewall of the device.

7. The combination according to claim 1, wherein each second fastening member extends from the first end to the second end of the device.

8. The combination according to claim 1, wherein each second fastening member extends generally parallel to the longitudinal axis when the device is mounted to the container.

9. The combination according to claim 1, wherein each first fastening member extends generally parallel to the longitudinal axis.

10. The combination according to claim 1, wherein the device is perforated.

11. The combination according to claim 1, wherein each second fastening member is generally convex and each first fastening member is generally concave.

12. The combination according to claim 1, wherein the container comprises a cap removably attachable to the body, the actuator extending upwardly from the cap along the longitudinal axis, the first fastening members extending on or in at east a portion of both the cap and the body.

13. The combination according to claim 1, wherein a length of the sidewall of the device, as measured along the longitudinal axis, is generally equal to a height that the actuator extends upwardly from the first end of the body of the container.

14. The combination according to claim 1, wherein the first fastening members are formed on or in a component that is removably mountable onto at least a portion of the body of the container.

15. A method of using a container having an actuator to dispense contents within the container, the method comprising:

rotating a device with respect to the container from a first rotational position to a second rotational position, the device generally surrounding the actuator in both the first and second rotational positions and an upper end of the device being positioned at a vertical level equal to, or above, a top of the actuator in both the first and second rotational positions; and moving the device solely linearly downwardly generally parallel to a longitudinal axis of the container from a first vertical position to a second vertical position, the device generally surrounding the actuator in the first vertical position, the actuator being generally exposed to allow a user to dispense the contents from the container when the device is in the second vertical position.

16. The method according to claim 15, further comprising:

depressing the actuator to dispense the contents from the container; and moving the device upwardly along the longitudinal axis from the second vertical position to the first vertical position to generally surround the actuator.

17. The method according to claim 16, further comprising:

placing another container onto a first end of the device for storage or transportation.

18. A method of using a container having an actuator to dispense contents within the container, the method comprising:

rotating a device with respect to the container from a first rotational position, wherein a first fastening member of the container is circumferentially spaced-apart from a second fastening member of the device, to a second rotational position, wherein the first fastening member of the container is aligned with the second fastening member of the device, the device generally surrounding the actuator in both the first and second rotational positions; and moving the device solely linearly downwardly generally parallel to a longitudinal axis of the container from a first vertical position to a second vertical position, the device generally surrounding the actuator in the first vertical position, the actuator being generally exposed to allow a user to dispense the contents from the container when the device is in the second vertical position.

* * * * *